US010912428B2

(12) United States Patent
Daffer

(10) Patent No.: US 10,912,428 B2
(45) Date of Patent: Feb. 9, 2021

(54) TIP FOR SKIN CLEANSING DEVICE

(71) Applicant: Visibelle Derma Institute, Inc., Bloomington, MN (US)

(72) Inventor: Steven J. Daffer, Edina, MN (US)

(73) Assignee: VISIBELLE DERMA INSTITUTE, INC., Bloomington, MN (US)

( * ) Notice: Subject to any disclaimer, the term of this patent is extended or adjusted under 35 U.S.C. 154(b) by 406 days.

(21) Appl. No.: 15/041,597

(22) Filed: Feb. 11, 2016

(65) Prior Publication Data

US 2016/0235257 A1 Aug. 18, 2016

Related U.S. Application Data

(60) Provisional application No. 62/115,471, filed on Feb. 12, 2015.

(51) Int. Cl.
*A47K 7/04* (2006.01)
*A61H 9/00* (2006.01)

(52) U.S. Cl.
CPC ..... *A47K 7/04* (2013.01); *A61H 9/0028* (2013.01); *A61H 9/0057* (2013.01); *A61H 2201/0207* (2013.01); *A61H 2201/105* (2013.01); *A61H 2201/123* (2013.01); *A61H 2201/5038* (2013.01)

(58) Field of Classification Search
CPC ..... A47K 7/04; A47K 7/02; A61H 9/0028; A61H 2201/0207; A61H 2201/105; A61H 2201/123; A61H 2201/5038; A61H 9/0057
See application file for complete search history.

(56) References Cited

U.S. PATENT DOCUMENTS

| | | | | | |
|---|---|---|---|---|---|
| 3,994,290 | A * | 11/1976 | Springer | A61H 15/02 | 601/131 |
| 6,129,469 | A * | 10/2000 | Messer | A45D 34/042 | 401/6 |
| 6,299,620 | B1 | 10/2001 | Shadduck et al. | | |
| 6,629,983 | B1 | 10/2003 | Ignon | | |
| 6,641,591 | B1 | 11/2003 | Shadduck | | |
| 7,678,120 | B2 | 3/2010 | Shadduck | | |
| 7,789,886 | B2 | 9/2010 | Shadduck | | |
| 8,048,089 | B2 | 11/2011 | Ignon et al. | | |
| 8,066,716 | B2 | 11/2011 | Shadduck | | |
| 8,337,513 | B2 | 12/2012 | Shadduck | | |
| 2002/0016601 | A1* | 2/2002 | Shadduck | A61B 17/50 | 606/131 |
| 2003/0060834 | A1* | 3/2003 | Muldner | A61B 17/54 | 606/131 |
| 2004/0153014 | A1* | 8/2004 | Sage, Jr. | A61H 7/003 | 601/159 |

(Continued)

*Primary Examiner* — Adam Marcetich
(74) *Attorney, Agent, or Firm* — Westman, Champlin & Koehler, P.A.

(57) ABSTRACT

A method and device for non-abrasively cleansing and exfoliating skin in combination with a cleansing solution. A cylindrical housing comprises a base for engagement with a fluid source and a vacuum source and a skin interface positioned on an end opposing the base and configured to contact and traverse a surface of the skin. The skin interface comprises non-abrasive, or rounded, smooth surfaces for contacting the skin. A combination of variable cleansing fluid delivery to the tip and vacuum pressure removal cleanses and exfoliates skin tissue or debris.

16 Claims, 5 Drawing Sheets

(56) References Cited

U.S. PATENT DOCUMENTS

| | | | | |
|---|---|---|---|---|
| 2007/0005078 | A1* | 1/2007 | Hart | A61B 17/54 606/131 |
| 2009/0198159 | A1* | 8/2009 | Linzell | A61H 7/003 601/138 |
| 2010/0064459 | A1* | 3/2010 | Varner | A46B 5/02 15/143.1 |
| 2010/0262051 | A1* | 10/2010 | De Laforcade | A61H 7/005 601/84 |
| 2013/0066336 | A1* | 3/2013 | Boone, III | A61B 17/545 606/131 |
| 2014/0014128 | A1* | 1/2014 | Tell | A61B 17/54 132/76.5 |
| 2014/0194900 | A1* | 7/2014 | Sedic | A61B 5/443 606/131 |
| 2014/0202493 | A1* | 7/2014 | Zelickson | A61B 17/32 134/6 |
| 2015/0088050 | A1* | 3/2015 | Chang | A61M 37/0092 604/20 |

* cited by examiner

TIP FOR SKIN CLEANSING DEVICE

CROSS REFERENCE TO RELATED APPLICATION

The present application is based on and claims the benefit of U.S. provisional patent application Ser. No. 62/115,471, filed Feb. 12, 2015, the content of which is hereby incorporated by reference in its entirety.

BACKGROUND

The present disclosure relates to devices for cleansing and rejuvenating the skin of a person. More specifically, the present disclosure relates to a replaceable tip for a cleansing fluid delivery device wherein the tip interfaces with the skin.

Maintaining the skin and/or surface of the skin in good condition requires proper washing for removal of dirt, debris and other pore clogging particles as well removing aged and/or dead skin cells or layers. Compounds such as sebum, which is secreted through the skin pores, is known to be superior in skin protection and refinement to any artificial skin conditioners. It is thus beneficial to remove particles, organisms, debris and dead or dying skin cells in order to support to the normal secretion of sebum from the skin surface, as these particles can accumulate and clog the skin pores. Further, the particle accumulation can also hinder skin respiration (dermal respiration) resulting in pimples, blackheads and rashes.

Prior art methods of cleansing the skin have been superficial, limited to washing with known face cleansers which are considered effective by temporarily keeping the face clean. However, such face washing is insufficient in that it fails to remove particles which have accumulated in the skin pores. Some cleansers even include chemicals including various types of acid (e.g. glycolic acid) to remove outer layers of skin and accumulated cells through chemical dissolution of the tissue. Such cleansers are not appropriate for those with sensitive skin and cause irritation and redness when used.

Alternative prior art methods of cleansing the skin to remove accumulated waste have also include physical exfoliation with abrasive surfaces for contacting the skin to remove the outer most layers of skin. These abrading methods cause pain during and after cleansing. Patients with sensitive skin may experience pain, itching, redness and or sensitivity long after the cleansing has been completed. In some instances, physical abrasion removes layers of skin too deep to be considered effective, opening areas of the skin surface up to infection.

SUMMARY

An aspect of the present disclosure relates to a system and device for non-abrasively cleansing and exfoliating the skin in combination with a fluid. The system comprises a handheld housing having a removable non-abrasive tip configured for contacting the skin. The tip has a recessed area bounded by a raised outer perimeter having a rounded outer surface, a convex domed feature within the outer perimeter, and a plurality of smooth rounded surfaces positioned within the perimeter. The system further comprises a liquid source connected to the handheld housing and configured to deliver liquid to the handheld housing as well as a vacuum suction source connected to the handheld housing and configured to remove used liquid and debris from the tip and handheld housing and to provide suction between the non-abrasive tip and the skin. A controller is configured for selectively adjusting liquid turbulence, bubble formation, frequency pulsation, air pressure variances, or combinations thereof thereby non-abrasively cleansing and exfoliating the user's skin.

The tip is a removable and replaceable non-abrasive tip configured for contacting the user's skin. The tip comprises a cylindrical housing having a skin interface portion at a first end and a base end at a second opposing end, the base end being configured for connection to a handle or wand that supplies at least a fluid and/or vacuum to the tip. The skin contact surface is configured to make contact with the skin surface and form a seal with the skin via a smooth round surface perimeter of the tip when vacuum suction is applied. The perimeter surface comprises an upwardly extending perimeter wall defining an interior space therein. The perimeter wall terminates in an upwardly or outwardly facing smooth rounded surface. This surface is the skin contact surface which contacts the skin during cleansing and exfoliation. A seal is formed between the skin contact surface and the surface of the skin to allow for the cleansing fluid to circulate in the interior space bounded by the perimeter wall and the skin surface.

An inlet aperture is provided for introducing fluid flow into the recessed area and a plurality of outlet apertures are configured for removing fluid and debris from the recessed area during cleansing. The inlet aperture may be positioned within the center of a convex dome feature positioned within the interior space. The outlet apertures may then be positioned around the perimeter thereof.

A first plurality of smooth rounded spacers protrude from the interior space on the skin interface portion bounded by the perimeter wall. The spacers have smooth rounded surfaces and may comprise upwardly extending rounded prongs positioned on a convex domed feature positioned within the interior space. The first plurality of spacers are fluid intake spacers and are thus positioned around the inlet aperture, which may be a fluid inlet, or fluid discharge port, and are configured to space the skin from the fluid inlet to allow the fluid to freely enter and circulate within the interior space. The inlet spacers may make intermittent or continuous contact with the skin surface during cleansing and exfoliating.

A second plurality of smooth rounded spacers may be outlet aperture spacers. The outlet aperture spacers may have a rounded length and may be spaced apart around an outer perimeter of the interior space of tip. The outlet spacers may be positioned between a perimeter of the domed fixture and the inner surface of the perimeter wall of the skin contact surface. These spacers are configured to space the skin from the vacuum ports, thus allowing the outlet apertures, or exit ports to allow for the suction and removal of fluid and debris from the interior area and to prevent the skin from clogging or covering an exit port positioned between two adjacent spacers. The outlet spacers may make intermittent or continuous contact with the skin surface during cleansing and exfoliating.

Another aspect of the present disclosure relates to a method for non-abrasively cleansing a surface of skin. The method comprises placing a tip having a skin contact portion in contact with the surface of skin, forming a sufficient vacuum seal between the skin and the skin contact surface, and continuously delivering a fluid, such as a cleansing fluid mixture, through an inlet aperture in the tip and into an interior space formed between the skin interface portion and the surface of skin. Cleansing and exfoliating further comprises traversing the tip in a selected pattern across the surface of the skin while maintaining a seal between the skin and the skin contact surface while continuously providing fluid and removing used fluid and debris from the interior space through at least one outlet aperture in the tip by vacuum pressure or negative fluid pressure. Further, cleansing and exfoliating can be controlled by adjusting at least one of a fluid delivery turbulence, fluid bubble formation, fluid pulsation, sound frequencies, negative pressure (vacuum), flow rate, fluid velocity or a mixture thereof.

DETAILED DESCRIPTION

Figure 1:
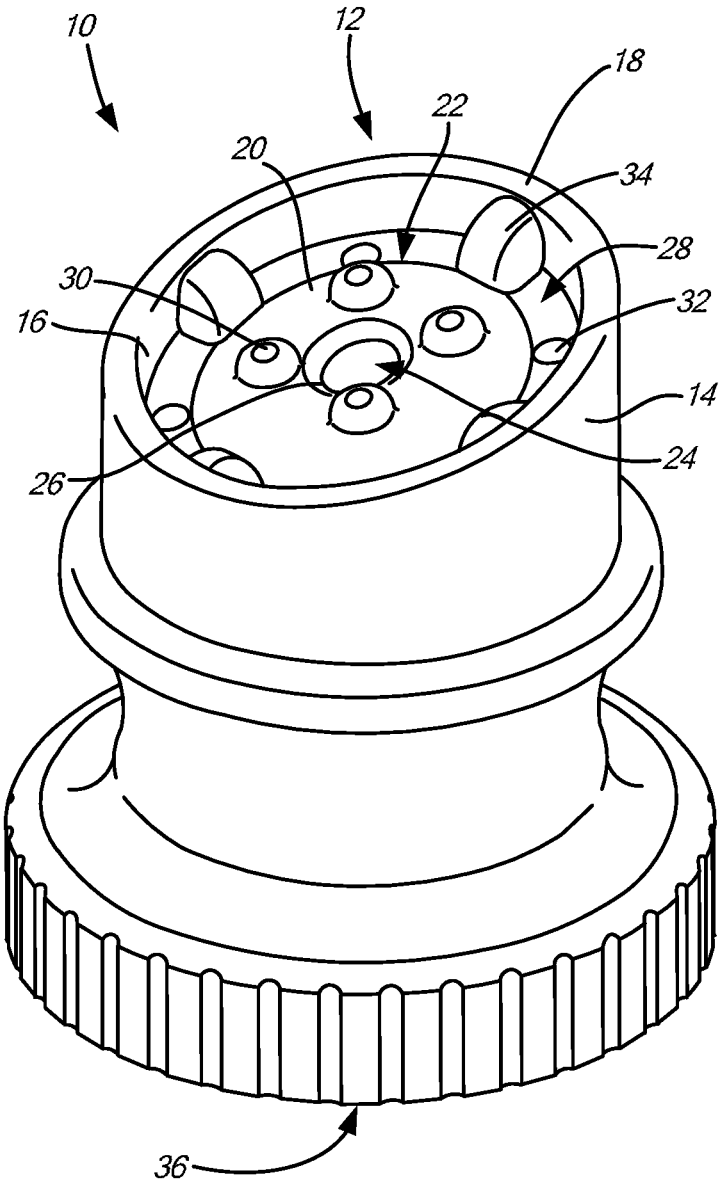
FIG. 1 is a perspective view of a tip for a skin cleansing device according to the present disclosure.
Figure 2:
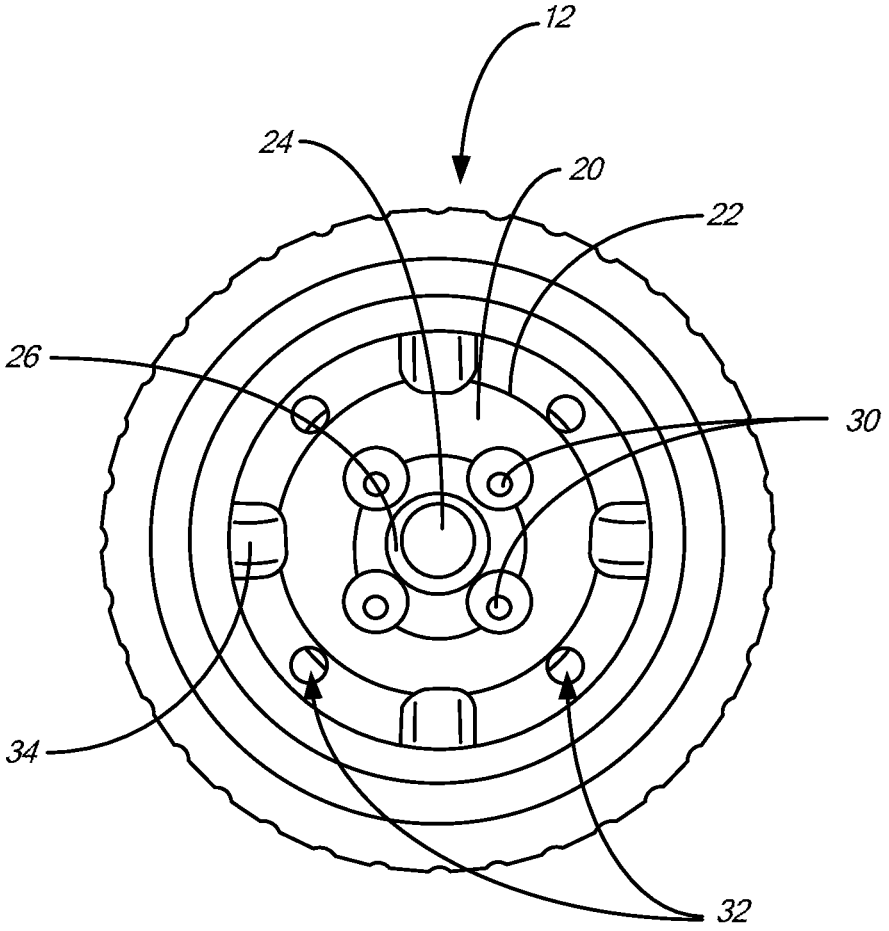
FIG. 2 is a top view of the tip.
Figure 3:
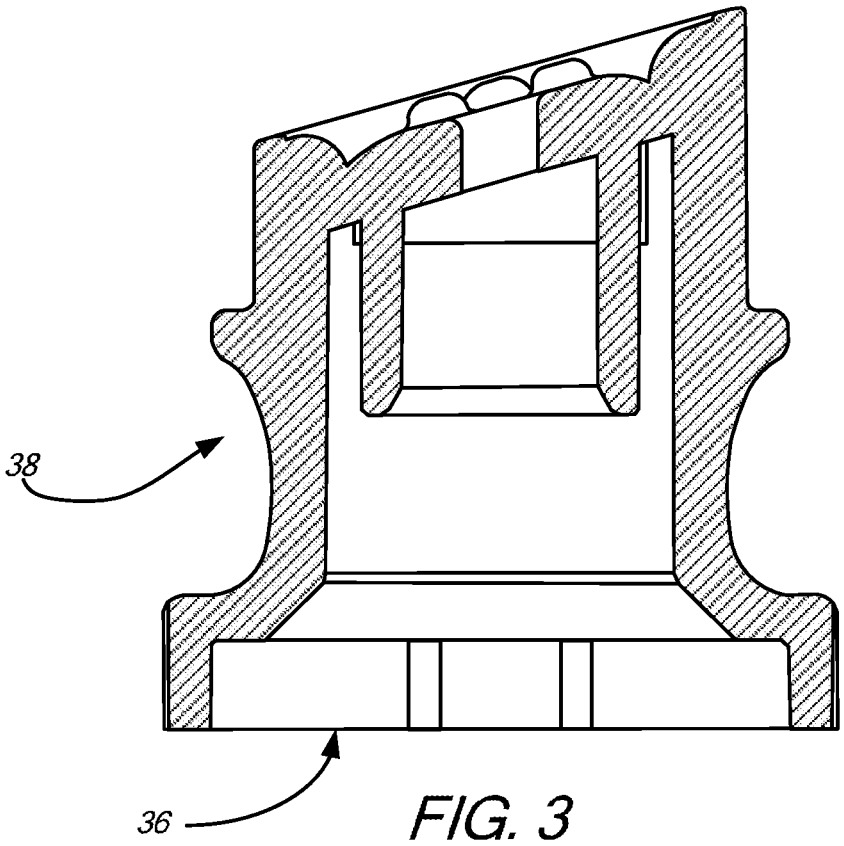
FIG. 3 is a sectional side view of the tip.
Figure 4:
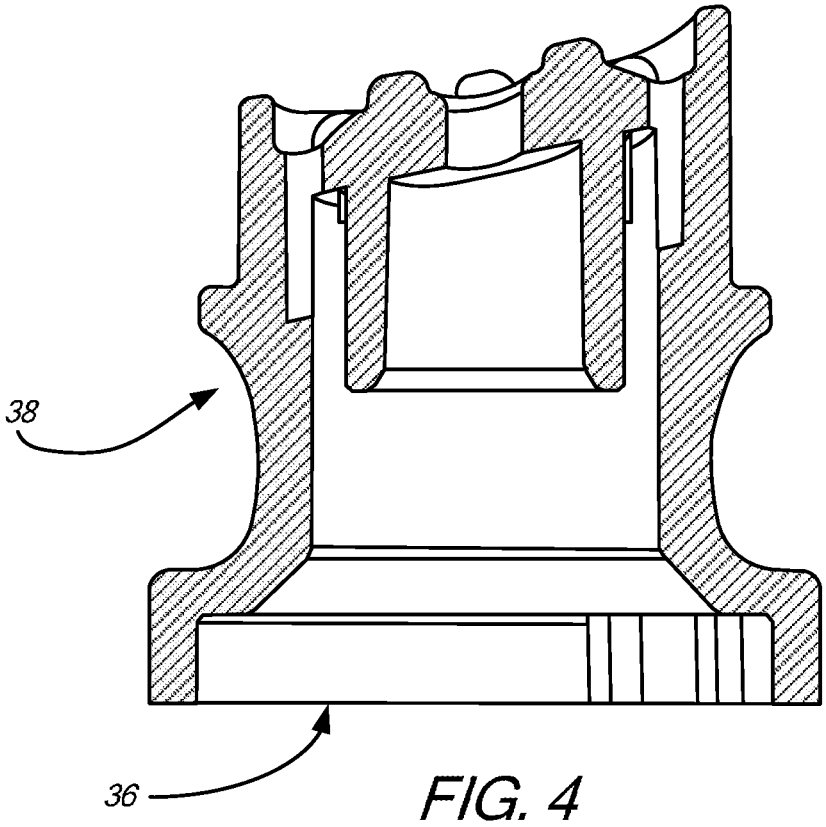
FIG. 4 is an alternative sectional side view of the tip.

The present disclosure is directed to a device for cleansing the skin safely and comfortably utilizing a liquid cleanser without abrading the skin. The cleansing and exfoliating device of the present disclosure includes a skin contact tip 10 configured for use with a liquid cleansing system. The tip 10 is configured for operable connection with a distal end of a handheld wand 40 or umbilical cord which is also operably connected to a machine for fluid delivery and for providing vacuum suction through the wand 40 to the tip 10. The system delivers liquid through the wand and to an aperture in the tip 10 and also removes fluid from the tip 10 through at least one aperture for vacuum suction and removal.

The system, including the tip 10, allows for exfoliation of the skin surface, which can occur without scraping and without an abrasive structure. For example, the tip 10 of the present disclosure is configured for use with a non-abrasive chemical solution, or a cleansing solution/fluid. The cleansing fluid cooperates with the tip 10, which can traverse the skin surface. The tip 10 forms a seal with the skin surface and traverses the skin surface while the cleansing fluid is simultaneously delivered to the tip. Delivery of the cleansing fluid can be selectively controlled and thus may be delivered in variable combinations and patterns of flow rates, flow velocities, liquid turbulence, bubbles, frequency pulsation, variations in sound frequencies, fluid temperature and/or air pressure variances to achieve exfoliation of the skin surface without an abrasive structure or abrasive surface component in the tip 10. This allows the tip 10 and cleansing fluid to gently exfoliate and cleanse pores by a non-abrasive, liquid only method where exfoliation is achieved by flow rates, flow velocities, fluid turbulence, temperature controlled fluid bubbles and pulsation, sound frequencies and/or adjustable negative air pressure (vacuum) to tip 10.

The tip 10 of the skin cleansing device as illustrated in FIGS. 1-6 comprises a skin surface interface 12. Interface 12 comprises a continuous, raised outer ring 14. The outer ring 14 is defined by a wall 16 having a suitable thickness in the range of about 0.8 to about 1.8 mm, where in the embodiment illustrated in the figures, the thickness of outer ring 14 is about 1.2 mm. The outer ring 14 comprises an upper ring or skin-contact surface 18 having a radius in the range of about 0.3 mm to about 0.7 mm, where in the embodiment illustrated in the figures, the radius of the upper ring surface 18 is about 0.5 mm. The upper ring surface 18 may have a radius at least two times smaller than the thickness of the outer ring 14, thus the diameter of the upper ring surface may generally be less than the thickness of the outer ring 14, providing a rounded skin contact surface to tip 10. However, due to the raised surface of the upper ring or interface 18 no edge of the outer ring 14 or the surface or interface 18 contacts the skin and forms a seal therewith.

Tip 10 further comprises a convex domed main body 20 having a perimeter 22 that is spaced from outer ring 14. The domed body 20 comprises at least one inlet port 24 with a concave 26 surface for directing cleansing solution into an interior cavity 28 formed between the tip 10 and the skin surface. The domed body 20 comprises a plurality of spaced about hemispheres 30, each hemisphere having a radius in the range of about 0.5 mm to about 1.5 mm, where in the embodiment illustrated in the figures, each has a radius of about 0.8 mm. Each hemisphere 30 protrudes outwardly from the outer surface of domed body 20. The hemispheres 30 may be a first plurality of spacers. These spacers are fluid intake spacers, and are thus positioned around the inlet port 24. The hemispheres 30 are configured to space the skin from the inlet port 24 during use to allow the fluid to freely enter and circulate within the interior space as a seal is formed between skin-contact surface 18 and the skin. The inlet spacers may make intermittent or continuous contact with the skin surface during cleansing and exfoliating. While a hemisphere 30 is illustrated, other non-abrading protuberances are also within the scope of the present disclosure.

In a surface separating the perimeter 22 of the domed main body 20 and the inner surface of the outer ring 14 are a plurality of outlet ports 32 for removal of cleansing solution. The outlet ports 32 may be intake holes that comprise integral apertures in said surface, allowing for vacuum drainage or suction removal of the cleansing solution and skin. The illustrated embodiment comprises three outlet ports 32, however two or more outlet ports may also be used and spaced along the surface at selected locations.

Said surface also provides a space in which a plurality of spaced protuberances 34 are positioned. Each protuberance 34 has at least one rounded surfaced and each protuberance has a radius in the range of about 0.7 mm to about 1.5 mm, where in the embodiment illustrated, the radius is above 1.0 mm. The protuberances are positioned in the space so as to extend from an inner wall of the outer ring 14 to the perimeter 22 of the domed main body 22. The illustrated example comprises four protuberances, however three or more protuberances may be incorporated and up to eight protuberances may be optionally spaced around the perimeter and incorporated into the tip 10. The protuberances 34 comprise a second plurality of smooth rounded spacers, which may be outlet port 32 spacers. The outlet port spacers are configured to space the skin from the outlet ports, allowing the vacuum suction through the outlet ports to remove used fluid and debris from the interior area without obstruction. These outlet port spaces are also configured to prevent the skin from clogging or covering an outlet port 32 positioned between two adjacent spacers 34. The outlet spacers may make intermittent or continuous contact with the skin surface during cleansing and exfoliating and are thus, rounded and smooth.

The interior hemispheres 30 may have a radius larger than a radius of the outer ring 14 and/or at least larger than a radius of the upper ring surface 18. The upper ring surface 18, the hemispheres 30 and the protuberances 34 each provide a substantially smooth, rounded surface, without edges, where the rounded surfaces may contact the skin surface when the tip 10 is used with the cleansing system. Tip 10 is thus configured to provide a non-abrasive cleansing system including delivery of a liquid cleansing solution to the skin surface or tissue, where the delivery tip 10 glides smoothly across the skin surface via substantial contact of at least substantially the entire upper ring skin contact surface 18 with the skin surface, forming a seal between the contacted skin surface and tip 10. Tip 10 may then traverse the skin surface by moving the wand with manual force, maintaining contact and a seal with the skin and in combination with vacuum pressure used to deliver and remove the cleaning solution through the inlet port 24 and outlet ports 32, respectively. Tip 10 may be comprised of a durable, lightweight and substantially smooth material, for example, tip 10 may be a molded plastic tip. Tip 10 may also be a disposable tip, designed for a single use, such that tip 10 can be removed from the system and disposed of after or between uses.

Figure 5:
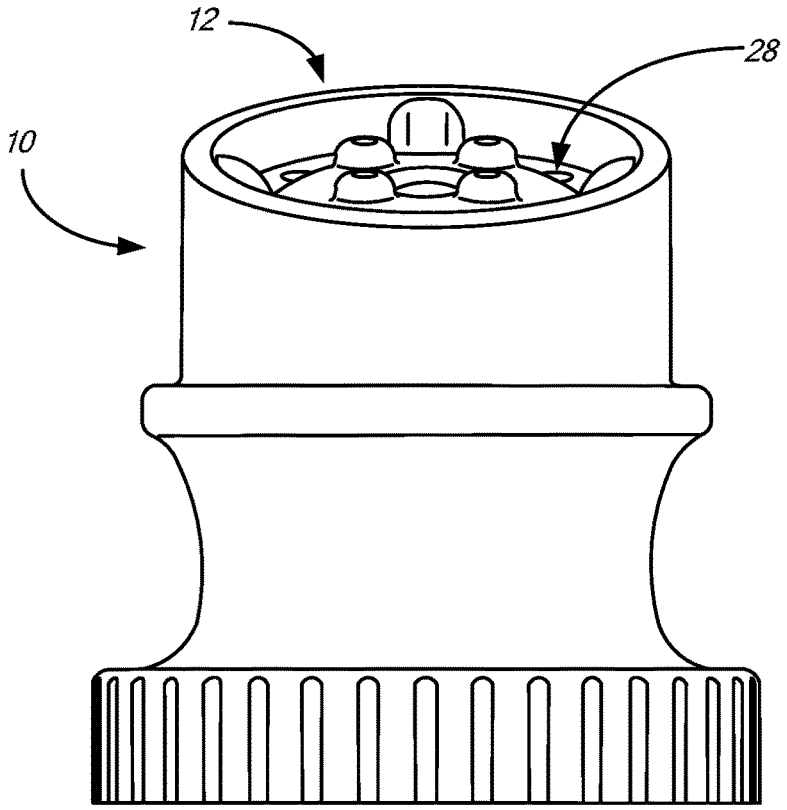
FIG. 5 is a front perspective view of the tip.
Figure 6:
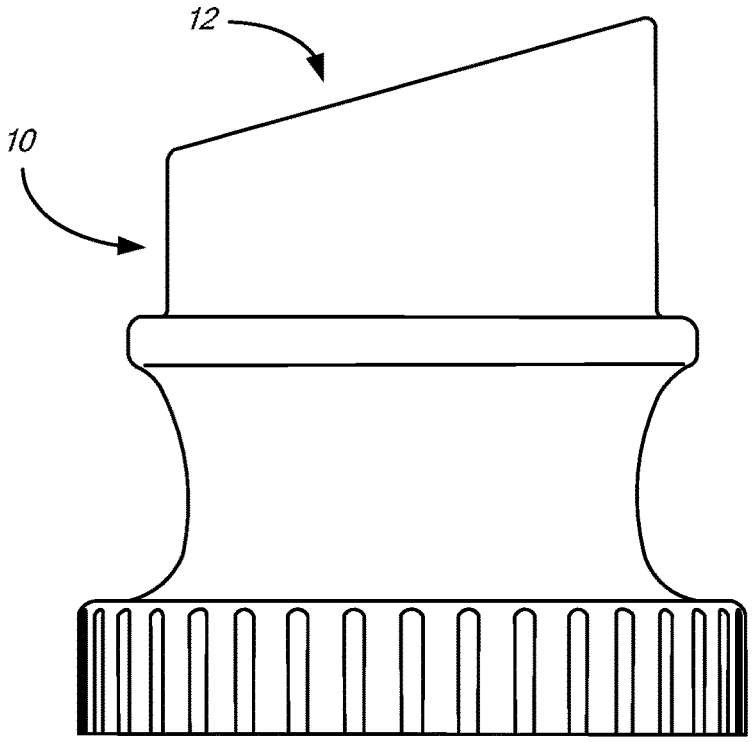
FIG. 6 is a side view of the tip.

As illustrated in FIGS. 5-6, skin interface 12 may be positioned at a slant or angle with respect to tip 10 and base 36 which is generally horizontal, providing an angled interface for contact with the skin surface. The skin interface 12 comprises the upper ring surface 18, the hemispheres 30, and the protuberances 34, any or all of which may contact skin during operation. Depending on levels of vacuum pressure and skin elasticity or integrity when traversing the skin a portion of the protuberances 34 may also contact the skin surface. These surface may all be smooth surfaces for allowing ease of movement of tip 10 along the skin surface. Skin interface 12 is also angled such that a first side may be lower height that a directly opposing side, where the interior space 28 remains bounded by height of the skin interface 12.

An operator causes tip 10 to traverse the user's skin surface in a selected treatment area while substantially maintaining the seal between the skin contact surface 18 of the tip 10 and the skin surface. The tip 10 may be traversed in selected patterns configured for treatment in connection with adjusting sound frequencies of the cleansing system or while pulsing delivery of the cleansing fluid. Tip 10, in combination with the skin cleansing device is configured for delivery of a non-abrasive cleansing solution and vacuum suction which cleanses and revitalizes the skin, including exfoliation of the skin surface and dermal tissue without physical abrasion or the need for an abrasive surface. The system is configured to utilize fluid turbulence, controlled fluid bubbles and pulsation, sound frequencies and adjustable negative air pressure (vacuum) delivered to and/or through tip 10.

The tip 10 is also configured with a base section 36 and a tubular length 38 which separates the skin interface portion and the upper ring surface 18 from the base 36 connection. The base 36 is configured for threaded connection, snapping or other operable engagement with a delivery wand or handle 40. The operator handles the wand or umbilical cord 40 which allows the operator to move the tip 10 across the skin in selected patterns. The tip 10 is thus generally a hollow cylinder in overall shape, providing an opening to the interior of the cylindrical portion of tip 10. The wand 40 allows the operator to select a tip, secure the tip 10 to the wand 40 and traverse the tip 10 across the person's skin. The wand 40 carries tubing 42 connected to a liquid supply reservoir and tubing 44 which is connected to a vacuum source 52 for removal of used cleansing fluid. The vacuum source 52 is provided with a controller and adjustable valve means for adjusting the pressure level setting to any suitable range. The operator will be able to adjust the setting based on the user's skin condition and other factors which allows the operator to select a vacuum pressure sufficient to achieve and maintain the selected level of suction against the user's skin.

Figure 7:
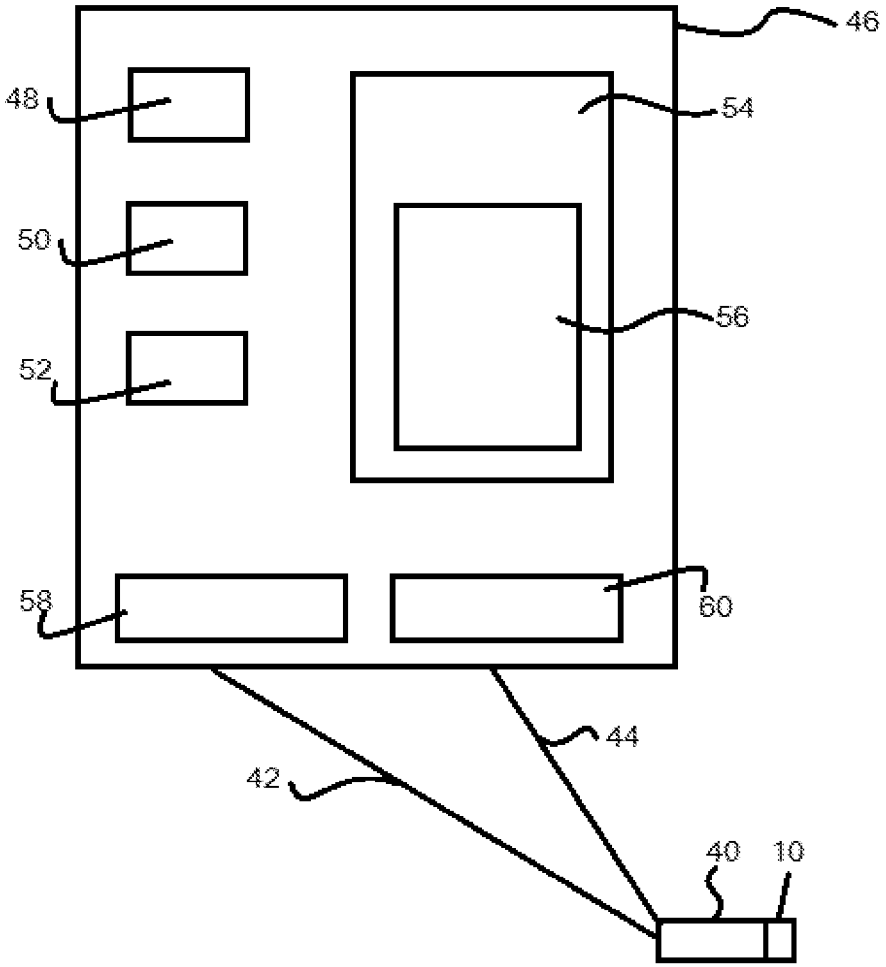
FIG. 7 is a schematic view of a skin cleaning system according to the present disclosure.

Referring to FIG. 7, the base 36 of the tip 10 is configured for operable connection to the wand 40. The tubing 42 and 44 is carried by the wand 40 and is connectable to appropriate inlet and outlet apertures within the tip 10 and extending to the interior area of the tip 10. Conduits allow for connection of the tubing 42 to inlet port 24 for cleansing fluid flow through tip 10 to the interior area and for connection to tubing 44 for vacuum pressure and thus removal of used cleansing fluid and dermal tissue from the skin surface and the tip 10. Opposing terminal ends of the tubing 42 and 44 connects the tip 10 via wand 40 to a machine 46 comprising at least a liquid warming or heating element 48 and a pump component 50 as well as the vacuum or suction component 52. The machine 44 is also configured with a controller 54 which may include a user interface 56 which allows the operator to selectively control fluid turbulence, fluid bubbles and pulsation, temperature, and/or sound frequencies of the fluid delivered to the tip 10 and/or air pressure (vacuum) of the fluid removed from the tip 10. The machine 44 is further connected to or comprises a refillable liquid supply or reservoir 58 and connection to a waste reservoir 60 for collection or disposal of used cleansing fluid removed from the tip 10.

Although the present disclosure has been described with reference to preferred embodiments, workers skilled in the art will recognize that changes may be made in form and detail without departing from the spirit and scope of the disclosure.

The invention claimed is:

1. A device for non-abrasively cleansing and exfoliating skin of a human being in using fluid and a vacuum, the device comprising:

a removable housing having a skin interface portion at a first end and a second opposing end configured for connection to a handle wherein the skin interface portion comprises:

an outer wall having a height, the outer wall comprising an upper surface with a convex portion, wherein the convex portion of the upper surface is configured to non-abrasively engage the skin of the human being and to form a seal with the skin;

a bottom wall together with the outer wall defining an interior space where the bottom wall connects to the outer wall at a distance from the upper surface of the outer wall;

a plurality of spaced apart substantially smooth rounded spacing elements extending from an inner surface of the outer wall and from the bottom wall, wherein each of the plurality of substantially smooth rounded spacing elements protrude upwardly from within the interior space;

an inlet aperture substantially centrally located within the bottom wall, wherein the inlet aperture is configured to introduce the fluid into the interior space; and one or more outlet apertures within the bottom wall and located between adjacent substantially smooth rounded spacing elements, the one or more outlet apertures are configured to remove fluid and debris from the interior space, wherein the adjacent spaced apart, substantially smooth rounded spacing elements prevent the one or more outlet apertures from plugging while the housing is moved over the skin to non-abrasively cleanse the skin of a human being using the fluid and the vacuum.

2. The device of claim 1, and wherein the bottom wall comprises a convex domed surface wherein the inlet aperture is located within the convex domed surface, wherein the inlet aperture is configured for connection to a fluid source for selectively controlling delivery of a supply of fluid into the interior space.

3. The device of claim 2, wherein the fluid is a cleansing fluid solution.

4. The device of claim 2, and further comprising a plurality of inlet aperture spacers positioned on the convex domed surface, wherein of the plurality of aperture spacers is configured to maintain a distance between the skin and the inlet aperture while the interior space is subjected to the vacuum.

5. The device of claim 1, wherein the one or more outlet apertures is configured to be connected to a vacuum source, such that the seal of the convex surface with skin along with a vacuum within the interior space provides for suction, drainage and removal of the fluid and skin debris.

6. The device of claim 1, wherein the one or more outlet apertures comprises a plurality of spaced apart apertures within the interior area, wherein each of the plurality of spaced apart apertures is located between adjacent spaced apart, substantially smooth rounded spacing elements.

7. A method for non-abrasively cleansing a surface of skin of a human being comprising:

providing a handheld housing having a removable tip, wherein the handheld housing is operably connected to a fluid supply and a vacuum source;

placing an upper surface of an outer wall the removable tip in contact with the surface of skin to form a seal with the surface of the skin wherein the upper surface has a convex surface to provide a non-abrasive skin interface portion;

delivering fluid through an inlet aperture in a bottom wall of the tip and into an interior space formed between the skin interface portion and the surface of skin;

moving the handheld housing in a selected pattern across the surface of the skin with the tip in sealing contact with the skin while maintaining the seal;

continuously removing used fluid and debris from the interior space through at least one outlet aperture in a bottom wall of the tip by utilizing a vacuum within the interior space wherein the removable tip includes a plurality of spaced apart, substantially smooth rounded spacing elements extending from the bottom wall and the outer wall, wherein the at least one outlet aperture is located between adjacent substantially smooth rounded spacing elements such that the at least one outlet aperture is prevented from plugging while non-abrasively cleansing and exfoliating skin of a human being in using the fluid and the vacuum; and adjusting at least one of a flow rate, flow velocity, fluid delivery turbulence, fluid bubble formation, fluid pulsation, negative air pressure (vacuum) or a mixture thereof.

8. The method of claim 7, wherein the fluid is a cleansing fluid.

9. The method of claim 7, wherein the tip further comprises a plurality of aperture spacers positioned on a convex domed feature within the interior space, wherein the plurality of inlet aperture spacers is configured to maintain a space between the skin surface and the inlet aperture.

10. A device for non-abrasively cleansing skin of a human being in using fluid and a vacuum, the device comprising:

a removable housing having a skin interface portion at a first end and a second opposing end configured for connection to a handle wherein the skin interface portion comprises:

an outer wall having a height, the outer wall comprising an upper surface with a convex portion, wherein the convex portion of the upper surface is configured to non-abrasively engage the skin of the human being and to form a seal with the skin;

a bottom wall attached the outer wall, wherein the bottom wall is attached to the outer wall a distance from the upper surface wherein the outer wall and the bottom wall define an interior space;

an inlet aperture within the bottom wall, wherein the inlet aperture is configured to introduce the fluid into the interior space;

a plurality of inlet aperture spacers having convex and non-abrading outer surfaces, the plurality of inlet aperture spacers positioned on the bottom wall surface, wherein of the plurality of inlet aperture spacers is configured to maintain a distance between the skin and the inlet aperture while the interior space is subjected to the vacuum; and one or more outlet apertures within the bottom wall, the one or more outlet apertures are configured to remove fluid and debris from the interior space.

11. The device of claim 10 and further comprising a plurality of spaced apart, substantially smooth rounded spacing elements protruding upwardly from within the interior space, wherein each of the plurality of spaced apart, substantially smooth rounded spacing elements extend from an inner surface of the outer wall and from the bottom wall wherein the plurality of spaced apart, substantially smooth rounded spacing elements prevent the one or more outlet apertures from plugging while non-abrasively cleansing and exfoliating skin of a human being in using the fluid and the vacuum.

12. The device of claim 10, and wherein the bottom wall comprises a convex domed surface wherein the inlet aperture is located within the convex domed surface, wherein the inlet aperture is configured for connection to a fluid source for selectively controlling delivery of a supply of fluid into the interior space.

13. The device of claim 10, wherein the fluid is a cleansing fluid solution.

14. The device of claim 10, and wherein each of the plurality of the inlet aperture spacers has a hemispherical surface.

15. The device of claim 10, wherein the one or more outlet apertures is configured to be connected to a vacuum source, such that the seal of the convex surface with skin along with a vacuum within the interior space provides for suction, drainage and removal of the fluid and skin debris.

16. The device of claim 10, wherein the upper surface is angled relative to the bottom surface.

* * * * *